United States Patent [19]

Ferri

[11] Patent Number: 4,843,751

[45] Date of Patent: Jul. 4, 1989

[54] TOY FIREARM OPERATED BY COMPRESSED AIR, WITH MAGAZINE IN AN ELEMENT IN THE GUISE OF A TRIGGER

[76] Inventor: Giampiero Ferri, Via Vecchia Fiesolana No. 74, S. Domenico Fraz. Com. di Fiesole, Florence, Italy

[21] Appl. No.: 202,990

[22] Filed: Jun. 6, 1988

[30] Foreign Application Priority Data

Jun. 11, 1987 [IT] Italy ..... 9413 A/87

[51] Int. Cl.[4] ..... F41B 11/00

[52] U.S. Cl. ..... 42/54; 124/67

[58] Field of Search ..... 42/54; 124/66, 67; 446/473

[56] References Cited

U.S. PATENT DOCUMENTS

| | | | |
|---|---|---|---|
| 1,666,579 | 4/1928 | Möller et al. | 42/54 |
| 2,434,436 | 1/1948 | Rochowiak | 124/67 |
| 2,633,838 | 4/1953 | Seward | 124/67 |
| 3,111,121 | 11/1963 | Baggott | 124/67 |
| 4,732,136 | 3/1988 | Ferri | 124/67 |

*Primary Examiner*—Deborah L. Kyle
*Assistant Examiner*—Michael J. Carone
*Attorney, Agent, or Firm*—Hopgood, Calimafde, Kalil, Blaustein & Judlowe

[57] ABSTRACT

The cylinder, with an axial attachment and axially perforated, is fixed in the firearm casing; a sliding element forms a trigger and housing for the magazine for the projectiles, the said element being subjected to the action of a return spring in the direction opposite to that of the manual action on the trigger; a thrust connection is provided between the said piston and the said element in order to actuate, through the travel of the trigger when pressed, the loading of the spring and, at the end of the said travel, the release of the piston.

2 Claims, 2 Drawing Sheets

II
III
F5
P
P1

TOY FIREARM OPERATED BY COMPRESSED AIR, WITH MAGAZINE IN AN ELEMENT IN THE GUISE OF A TRIGGER

The subject of the invention is a toy firearm operated by compressed air, of the type comprising a cylinder with an axial attachment which is axially perforated to provide a tubular element, a piston disposed in said cylinder subjected to the thrust of a coaxially disposed spring for the discharge of a projectile by the action of air compressed by the action of said spring against said spring in the cylinder-piston system when the loaded spring is trigger-released, and—generally—a magazine for the projectiles from which a projectile is removed for firing—by the action of the said attachment—wi-thevery firing cycle. According to the invention, the cylinder and related attachment are fixed in a firearm casing, whilst a sliding element forms a trigger and housing for the projectiles or the magazine for the projectiles; the said element is subjected to the action of a return spring in the direction opposite to that of the manual action on the trigger; a thrust connection is provided between the said piston and the said element in order to actuate, through the travel of the trigger when pressed, the loading of the spring and, at the end of the said travel, the release of the piston.

The piston can to advantage exhibit a lateral rod designed to be engaged by a resilient detent forming part of the trigger mechanism for manually operated travel of the trigger and loading of the piston spring; the said resilient detent is actuated at the end of the travel by an inclined profile in order to release the piston and cause it to spring forward.

Figures 1, 2, 3:
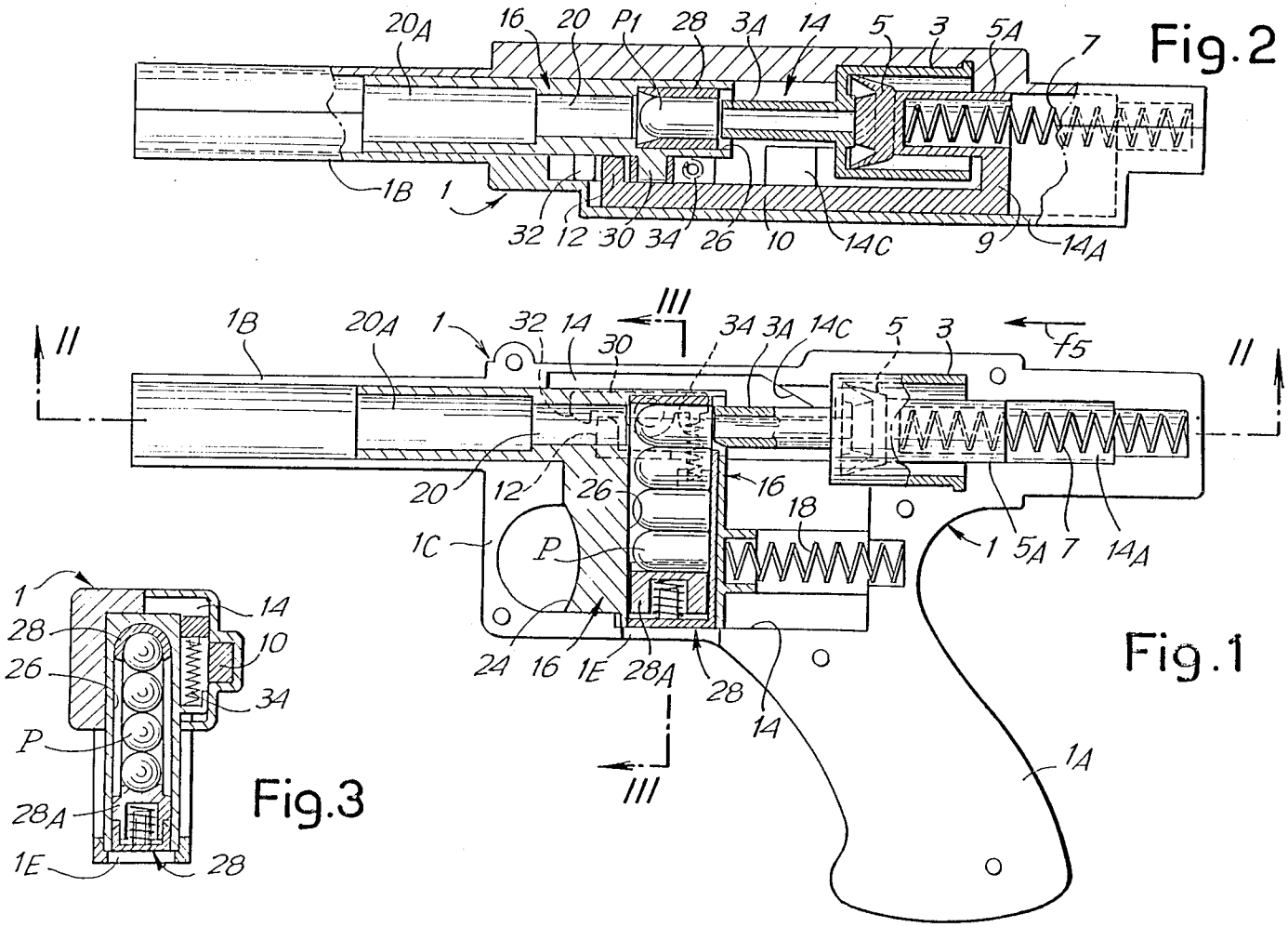
Figure 4:
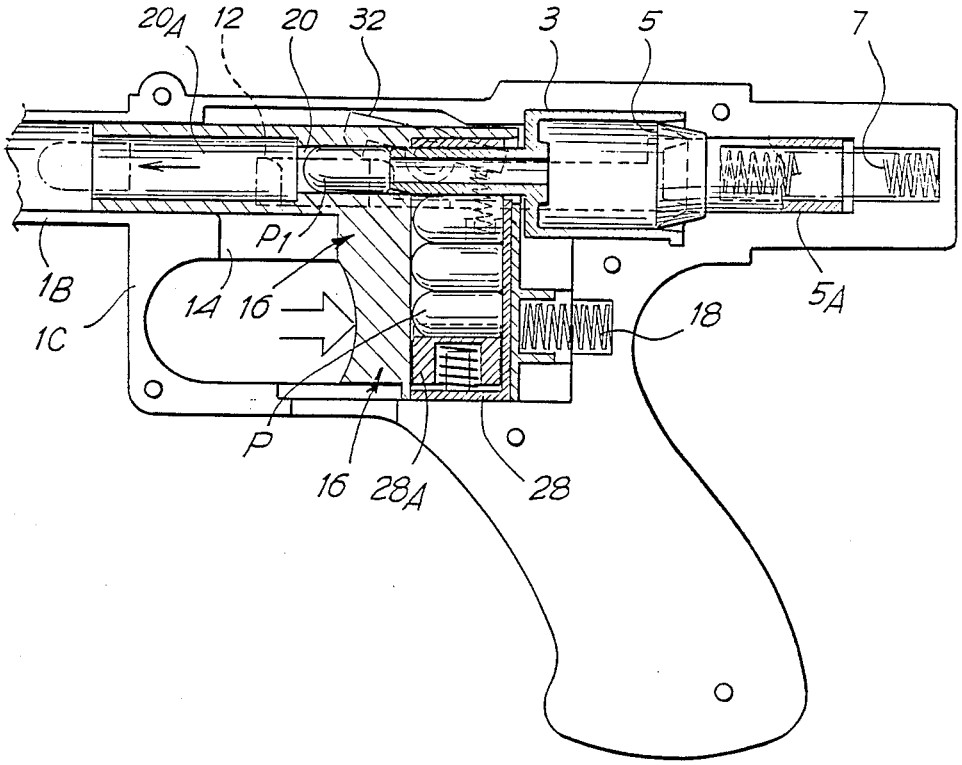

The invention will be more readily understood if the specification is studied in conjunction with the attached drawings; these illustrate one practical embodiment of the invention, to provide a non-limitative example. In these drawings, FIG. 1 represents a longitudinal section of the toy firearm in the rest position after firing;

FIGS. 2 and 3 represent sections in accordance with the lines II—II and III—III in FIG. 1; and FIG. 4 represents a partial view as shown in FIG. 1 illustrating the cocked position.

As illustrated in the attached drawings, 1 is the generic indicator for the casing of the toy firearm, which can imitate the shape of a pistol. The casing has a butt or handle 1A extending downwardly therefrom and a front attachment 1B in imitation of a gun barrel. Inside the casing is housed a cylinder 3 with a perforated longitudinal axial attachment 3A in the form of a tubular element coaxiallly extending forwards in line with the tubular attachment 1B, said cylinder 3 being coaxially disposed rearwardly of attachment 1B. 5 indicates a piston slidingly disposed inside the cylinder 3 so as to create pneumatic pressure when thrust in the direction of the arrow f5. The piston 5 includes a hollow rod 5A coaxially connected thereto and accommodating a spring for loading and discharging indicated by 7, which urges the piston in the direction of the arrow f5. The rod 5A of the piston 5 is coupled to a lateral connector 9 which included a lateral rod 10 (see in particular FIG. 2) extending at the side of and in parallel with the cylinder 3 and tubular element 3A. This rod 10 has a detent 12 at its front end, designed to operate in conjunction with a resilient retaining detent that is described below.

A slide housing 14 extends inside the casing 1 in which a sliding element, generically indicated by 16, can slide—parallel with the axis of the cylinder 3 and the piston 5. This element is urged by a spring 18 in the same direction of the arrow f5 and has a hole 20 through it serving as a barrel for firing a projectile in the position P1, as shown in FIG. 4; this barrel 20 is fitted with or opens to a wider extension 20A, also accommodated in tubular attachment 1B of casing 1. The element 16 also comprises a trigger profile 24 which can be operated through an opening defined by a trigger guard 1C in the casing 1. The element 16 also comprises a housing 26 for a stack of projectiles P, which can be held in a magazine 28; the magazine 28 can be extracted through an opening 1E in the bottom of the casing 1 and can be inserted in the said housing 26 so that the projectile at the top is aligned with the barrel 20 in the element 16; a resilient pressure device 28A located at the bottom of housing 26 urges the stack of projectiles upwards, so that one of the projectiles is always aligned with the barrel 20. The barrel 20 is in alignment with the projectile at the top of the stack and with the axially perforated attachment or tubular element 3A of the cylinder 3. The element 16 incorporates a joint pin 30 for a resilient retaining detent 32 capable of operating in conjunction with the detent 12 of the rod 10 of one piece with the piston 5; the resilient detent 32 is urged by a spring 34 reacting between the rocking resilient detent 32 and a support on the element 16. The slide housing 14 for the element 16 has an extension constituting the slide housing for the piston rod 5A and the lateral rod 10; the recess for these components is indicated by 14A. In the recess 14 there is also constructed an inclined profile 14C operating, in the manner described below, in conjunction with the end of the resilient detent 32 that is opposite the operative end of this detent.

In the position illustrated in FIG. 1, the firearm is in the rest position, and shows a projectile in position P1 aligned with the barrel 20 in front and with the perforated attachment or tubular element 3A at the rear. The element 16 is in the forward position, following the direction of the arrow f5, and the piston 5 is also in the forward or discharge position in the cylinder 3, and therefore at the end of its power stroke. To cock the compressed-air firing system, and trigger automatic firing when the full-cock position is reached, the trigger 24 formed by the sliding element 16 is operated so that this element is displaced in the direction opposite to that indicated by the arrow f5 and against the action of the spring 18 and the spring 7; in effect, with the retraction of the element 16 (via the trigger 24) in the opposite direction to that indicated by the arrow f5, the resilient detent 32 engages the detent 12 and also displaces in the opposite direction to that indicated by the arrow f5 the rod 10 and so the piston 5, compressing with it the spring 7. Towards the end of the aforesaid cocking action, the rear end of the resilient rocker detent 32 comes into contact with the inclined surface 14C of the slide housing 14 for the element 16 and the resilient detent 32 is displaced—against the action of the spring 34—until it is released from the detent 12. As soon as the detent 12 loses contact with the resilient retaining detent 32 (see FIG. 4) the spring 7, having been compressed by this action, is in a position to propel the piston 5 back from its retracted position as shown in FIG. 4 to the position shown in FIG. 1, following the direction of the arrow f5; this compresses the air inside the cylinder 3 which then, escaping through the axial hole in the attachment or tubular element 3A, thrusts the projectile P1 forward into the firing position in the barrel 20 and projects it out of the barrel 20 and its extension 20A and the axial recess of the attachment 1B into the open. Once firing has been completed, and action on the trigger 24 has ceased, the spring 18 starts to push forward, in the direction of the arrow f5, the element 16 of the trigger 24 until the said element 16 has reverted to the position shown in FIG. 1 from the position in FIG. 4. In the position in FIG. 4, the stack of projectiles P is pushed up from below by the pressure device 28A against the attachment 3A of the cylinder 3 which, after the retraction of the element 16, has come into alignment with the magazine 28 and thrust forward the projectile P1 into the barrel 20 ready for firing in the manner aforesaid; in the said return travel of the element 16, through the spring 18, the movement of the element in the direction of the arrow f5 causes the attachment 3A to be detached from the magazine, whereby the top one of the projectiles P in the stack of projectiles contained in the magazine 28 is positioned in alignment with the barrel 20 and the attachment 3A, as shown in FIG. 1, in such a way that a new projectile in this position can first, the next time the action of firing is actuated by pressure on the trigger 24, be pushed into the barrel 20 and then projected by compressed air in the manner described.

The firearm is automatic in the sense that (with the magazine inserted) any pressure on the trigger 24 causes the spring 7 to be loaded and hence, with the travel of the trigger completed, the release action and pneumatic thrust for firing the projectile; on completion of the return travel another projectile is automatically placed in the firing position.

The drawings, it should be understood, illustrate only one possible version by way of example, as a practical demonstration of the invention, which can take the form of a variety of embodiments and arrangements without any departure from the scope of its underlying concept. The appearance of reference numerals in the claims that follow is intended to make it easier for the reader to relate the claims to the specification and to the drawings, and does not imply any limitation on the scope of the protection represented by the claims.

I claim:

1. A toy firearm operated by compressed air comprising a casing (1) having a butt or handle (1A) extending downwardly therefrom;

said casing (1) having a forwardly extending attachment (1B) housing a gun barrel, a cylinder (3) housed within casing (1) disposed coaxially rearwardly of attachment (1B) and including a tubular element (3A) communicating with cylinder (3) and extending coaxially forward therefrom, a piston (5) slidingly disposed within cylinder (3) and having coaxially connected thereto a hollow rod (5A) accommodating a loading spring (7) for loading and discharging said piston (5) for compressing air in cylinder (3) for discharge through tubular element (3A), a sliding element (16) and associated trigger means (24) disposed in casing (1) and located forward of said butt or handle (1A), said sliding element (16) being disposed in coacting relationship with return spring (18) following firing of the firearm, a housing (26) for projectiles (P1) located within said sliding element (16), said housing including a resilient pressure device (28A) located at the bottom thereof for urging a stack of projectiles upwardly after each discharge thereof, thrust means (9, 10) slidingly coupling said piston (5) to sliding element (16), including triggerr means (24) to enable cocking of said firearm by applying pressure on trigger means (24), and means within said casing (1) for releasing spring (7) following loading thereof to thereby compress air in cylinder (3) for discharge through tubular element (3A) to propel projectile (P1) therefrom.

2. The firearm as in claim 1, wherein thrust means (9, 10) includes detent means (12) which coacts with resilient detent (32) cooperably associated with trigger means assembly (16, 24) to effect loading of spring (7) when trigger means is operated, and such that when trigger means is further operated at the end of travel during loading, detent (32) contacts inclined profile (14C) within casing (11) to effect release of loaded spring (7) and cause the piston to discharge and compress air in cylinder 3.

* * * * *